United States Patent [19]

Unbehaun et al.

[11] 3,942,448

[45] Mar. 9, 1976

[54] APPARATUS FOR CONSOLIDATING BALLAST

[75] Inventors: Olaf Unbehaun, Neunkirchen; Uwe Hampel, Ludwigshafen; Norbert Scholz, Mannheim; Horst Gassmann, Viernheim; Walter Schneider, Ludwigshafen; Heinz Hesser, Hochdorf-Assenheim; Walter Herrmann, Mannheim; Bertold Bechert, Nuremberg, all of Germany

[73] Assignee: BASF Aktiengesellschaft, Ludwigshafen (Rhine), Germany

[22] Filed: May 24, 1974

[21] Appl. No.: 473,174

[30] Foreign Application Priority Data

May 26, 1973 Germany ..... 7317950[U]

[52] U.S. Cl. ..... 104/11; 104/12

[51] Int. Cl.[2] ..... E01B 1/00

[58] Field of Search ..... 104/11, 14, 12

[56] References Cited

UNITED STATES PATENTS

| | | | |
|---|---|---|---|
| 2,669,942 | 2/1954 | Scheuchzer | 104/11 |
| 3,656,690 | 4/1972 | Hanig | 104/11 |

*Primary Examiner*—Robert R. Song
*Assistant Examiner*—Richard A. Bertsch
*Attorney, Agent, or Firm*—Johnston, Keil, Thompson & Shurtleff

[57] ABSTRACT

A track or switch tamping machine wherein the machine includes tamping and ramming units having longitudinal ducts for injecting liquid binder into the ballast. The longitudinal ducts terminate in a plate or cavity within the lower portion of the tamping and ramming units. A nozzle is also included in the unit as is means for conveying liquid binder from a storage tank carried on the machine.

3 Claims, 4 Drawing Figures

Figure 2:
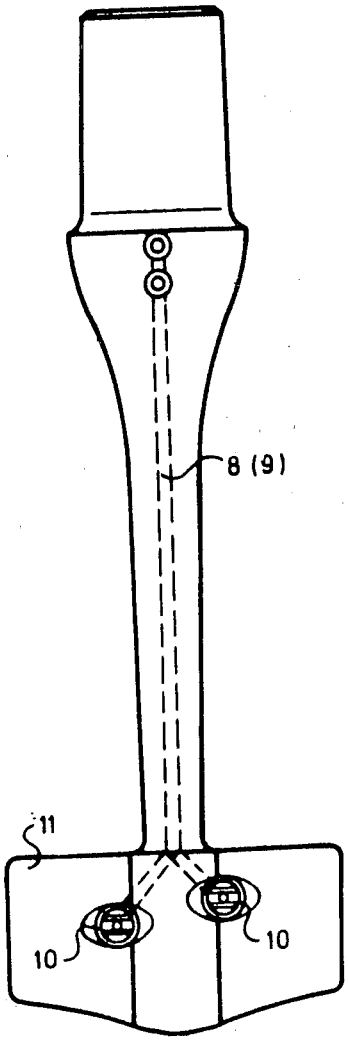

FIG. 1
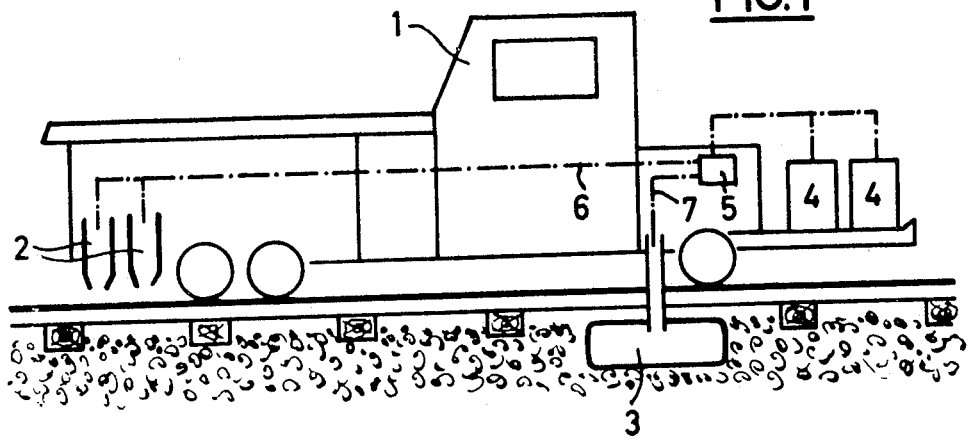
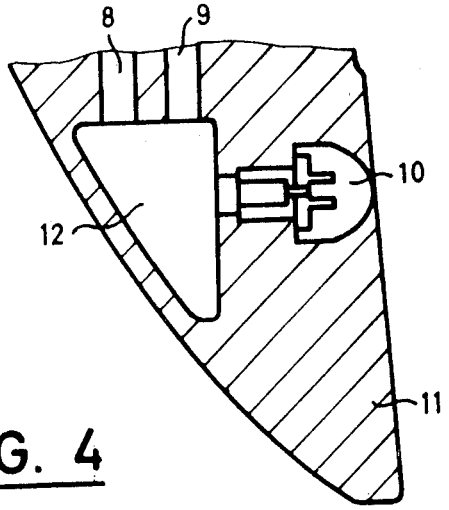
FIG. 4

APPARATUS FOR CONSOLIDATING BALLAST

This invention relates to apparatus for consolidating ballast with liquid binders, consisting of a track or switch (points) tamping machine having tamping and ramming units and means for holding and conveying said binders.

The characteristic feature of modern roadbeds is the combination of rails, crossties (sleepers) and ballast. One important function of the rails is to distribute the load in the longitudinal direction, which means that there must be adequate resilience, which is ensured by the yield chracteristics of the ballast. In addition, the track laid in the ballast should show high resistance to transverse displacement to satisfy an important prerequisite for exact alignment of the track over a long period of time. On account of the static and dynamic stresses caused by the mixed traffic of fast passenger trains and slow goods trains, the ballast gradually loosens, particularly where the track is curved, and there is unequal settlement. However, this can only be rectified by periodic maintenance by means of large machines moving along the rails and tamping the ballast beneath the ties. Additional ramming on the shoulders and in the cribs enables the entire ballast to be packed firmly together. However, it is not possible to achieve permanent consolidation of the ballast by this means. For example, slight loosening of the ballast occurs when the tampers are removed. Furthermore, the nonlinear behavior of the ballast with time further impairs track alignment. The rate at which this occurs depends, inter alia, on the subgrade, the amount of traffic, train speeds and the ratio of passenger to goods trains. Periodic maintenance alone is not sufficient to ensure the necessary standards. For this reason, German Published Application 2,063,727 proposes a method of bonding the ballast completely or partially, in particular at the points of conact, with a binder so as to stabilize the ballast. The binder is injected into the ballast and fills up the voids on curing with or without the formation of a foam. However, when using this method, no binder penetrates to the region beneath the ties, an important load-bearing region, this being particularly the case when the ballast has already been tamped. Said published application does not disclose any suitable equipment by means of which satisfactory bonding of the ballast can be achieved.

We have now found an apparatus of the above kind for bonding ballast and obviating the above drawbacks, this apparatus being characterized in that each unit has one or more longitudinal ducts which end in a plate in the lower part of the unit. Advantageously, nozzles are mounted at the ends of the ducts. In one advantageous embodiment of the apparatus, the ducts end in a cavity in the lower part of the unit, which cavity communicates with at least two nozzle shaped bores. According to a further feature of the invention, the said bores are in vertical staggered relationship to each other.

By this means, binders such as polymer dispersions may be introduced into the ballast in a desired manner in the course of periodic maintenance. Another advantage is the uniformity of the coating of polymer dispersion on the ballast rock, even in the lower regions of the ballast.

One embodiment of the apparatus of the invention is illustrated diagrammatically, by way of example, in FIGS. 1 to 4 of the accompanying drawings and is further described below.

Figure 3:
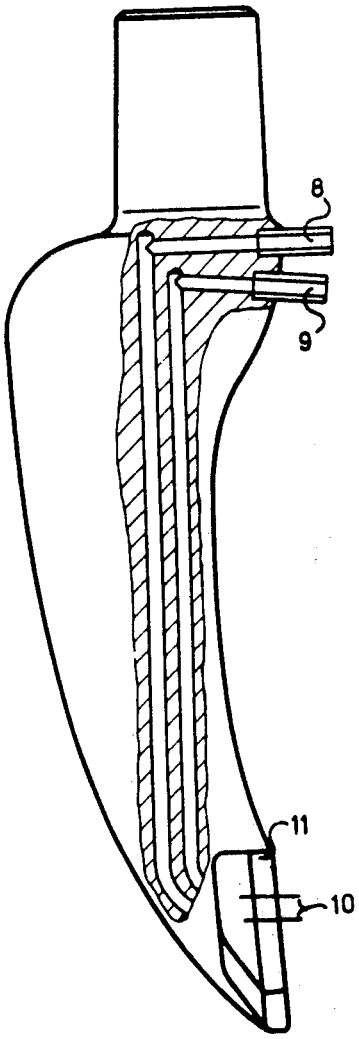

FIG. 1 is a side view of a track or points tamper equipped with tamping and ramming means, FIGS. 2 and 3 show two different views of the unit and FIG. 4 is a cross-section of the lower part of the unit containing a cavity.

Referring to FIG. 1, a tamper 1 has, on both sides thereof, tamping means 2 and ramming means 3. Equipment such as reservoirs 4 and pumps 5 for holding and conveying the binder are mounted on the machine. The binder generally consists of a polymer dispersion or a mixture of polymer dispersions with or without additives. The pump 5 conveys the dispersion to a pressure tank or directly to a pipe system from which it passes through hoses 6 and 7 and valves or stop-cocks to units 2 and 3. If a precipitant is required for bonding the ballast, this is introduced into the ballast in a similar manner.

Units 2 and 3 are provided with one or, preferably, a plurality of ducts 8 and 9 through which the dispersion passes to nozzles 10 in the plate 11 in the lower part of the unit from which it is injected under pressure into the zones to be stabilized, particularly the zones beneath the ties and rails, as the units 2 are lowered into the ballast and closed while being vibrated, and also into the shoulders during ramming (ramming units 3). It is possible for the ducts 8 and 9 to end in a cavity 12 leading to from 1 to about 4 nozzle-shaped bores or nozzles 10, which are advantageously in vertical staggered relationship to each other. The nozzles 10 operate only during the lifting and compacting operations. After the unit has penetrated the ballast, control valves (not shown) are opened usually by means of end switches or by mechanical means. When the units reemerge from the ballast, the valves close. Alternatively, the valves may be controlled by timers. The time required for insertion of the units and the injection rate of the binder may be readily determined for each unit according to requirements.

We claim:

1. Apparatus for tamping ballast and consolidating ballast with liquid binders which comprises:

a. base means mounted on wheels for movement on rails of a train bed;

b. storage means mounted on said base for holding said liquid binder;

c. tamping and ramming units mounted on said base for contacting railroad ballast;

d. a plurality of injection means within and combined with said tamping and ramming units for contacting said ballast with said binder, said injection means including an end piece capable of insertion into said ballast, a plurality of longitudinal ducts within said end piece and nozzle shaped bores in communication with said ducts;

e. conveyor means for delivering said liquid binder from said storage means to said nozzle shaped bores under pressure; and, f. means for inserting said end piece into and removing said end piece from said ballast.

2. Apparatus as set forth in claim 1, wherein the ducts end in a cavity in the lower part of the unit, which cavity communicates with at least two nozzle-shaped bores.

3. Apparatus as set forth in claim 1, wherein said bores are in vertical staggered relationship to each other.

* * * * *

UNITED STATES PATENT AND TRADEMARK OFFICE

CERTIFICATE OF CORRECTION

PATENT NO. : 3,942,448

DATED : March 9, 1976

INVENTOR(S) : UNBEHAUN et al

It is certified that error appears in the above-identified patent and that said Letters Patent are hereby corrected as shown below:

In the Heading, delete " [30] Foreign Application Priority Data May 26, 1973 Germany 7317950[U] " and substitute -- [30] Foreign Application Priority Data May 26, 1973 Germany G 73 19 950.5 --

In Column 1, Line 14, delete "chracteristics" and substitute --characteristics--

Signed and Sealed this

Fourteenth Day of September 1976

[SEAL]

*Attest:*

RUTH C. MASON
*Attesting Officer*

C. MARSHALL DANN
*Commissioner of Patents and Trademarks*